US009266223B2

(12) United States Patent
Hoang

(10) Patent No.: US 9,266,223 B2
(45) Date of Patent: Feb. 23, 2016

(54) HAND TOOL AND METHOD OF USING SAME

(71) Applicant: QUIC INDUSTRIES, Coronado, CA (US)

(72) Inventor: Nam Quoc Hoang, San Diego, CA (US)

(73) Assignee: Quic Industries, Coronado, CA (US)

( * ) Notice: Subject to any disclaimer, the term of this patent is extended or adjusted under 35 U.S.C. 154(b) by 265 days.

(21) Appl. No.: 14/037,146

(22) Filed: Sep. 25, 2013

(65) Prior Publication Data

US 2014/0041195 A1 Feb. 13, 2014

Related U.S. Application Data

(63) Continuation-in-part of application No. 12/137,482, filed on Jun. 11, 2008, now Pat. No. 7,717,017, and a continuation-in-part of application No. 29/467,935, filed on Sep. 25, 2013, now Pat. No. Des. 724,916.

(51) Int. Cl.

| | |
|---|---|
| ***B25B 7/12*** | (2006.01) |
| ***B25G 1/06*** | (2006.01) |
| ***B26B 17/02*** | (2006.01) |
| ***A45D 29/02*** | (2006.01) |
| ***B26B 17/00*** | (2006.01) |
| ***B25B 7/00*** | (2006.01) |
| ***B25B 7/04*** | (2006.01) |
| ***B25B 7/02*** | (2006.01) |

(52) U.S. Cl.

CPC . *B25B 7/12* (2013.01); *A45D 29/02* (2013.01); *B25B 7/00* (2013.01); *B25B 7/02* (2013.01); *B25B 7/04* (2013.01); *B25G 1/06* (2013.01); *B26B 17/006* (2013.01); *B26B 17/02* (2013.01); *Y10T 29/4984* (2015.01)

(58) Field of Classification Search

CPC ..... B25G 3/38; B25G 1/06; B25B 9/00; B25B 7/00; B25B 7/02; B25B 7/04; B25B 7/12; B26B 17/006; B26B 17/02; A45D 29/02; Y10T 29/4984

See application file for complete search history.

(56) References Cited

U.S. PATENT DOCUMENTS

| | | | |
|---|---|---|---|
| 1,959,587 | A | 5/1934 | Lawson |
| 2,020,242 | A | 11/1935 | Geddes |
| 2,109,147 | A | 2/1938 | Grosso |
| 2,507,710 | A | 7/1973 | Grosso |
| 5,063,666 | A | 11/1991 | Tsay |
| 5,666,728 | A | 9/1997 | Silva |
| 6,173,497 | B1 | 1/2001 | Domenge |

(Continued)

OTHER PUBLICATIONS

Hsin-Chieh Wu, et al. "Nail Clipper Design for Elderly Population", on-line at http:ir.lib.cyut.edu.tw:8080/bitstream/310901800/12881/2/nail+clipper+design+for+elderly+population.pdf published Jan. 1, 2012.

(Continued)

*Primary Examiner* — David B Thomas

(74) *Attorney, Agent, or Firm* — Jerry R. Potts; James R. McDaniel

(57) ABSTRACT

Hand tool and method of manufacturing and using same. The hand tool includes a tool mount including at least one heim joint that removably receives thereon a tool head assembly. The heim joint and tool head assembly cooperate to provide the hand tool with a multi-directional, variable angle of attack on a work piece in a manner that accommodates aged, arthritic and otherwise handicapped people having a limited range of arm, wrist and hand movement.

18 Claims, 18 Drawing Sheets

(56) References Cited

U.S. PATENT DOCUMENTS

| | | | | |
|---|---|---|---|---|
| 6,473,969 | B2 * | 11/2002 | Rinaldi | A45D 29/02 30/186 |
| 6,581,246 | B1 * | 6/2003 | Polette | A01D 34/90 16/426 |
| 6,918,324 | B2 * | 7/2005 | Hsien | B25B 7/00 30/191 |
| 7,020,964 | B2 | 4/2006 | Han et al. | |
| 9,126,344 | B2 * | 9/2015 | Grisoni | B26B 13/04 |
| 2011/0203500 | A1 * | 8/2011 | des Garennes | A01C 23/028 111/7.3 |

OTHER PUBLICATIONS

Speedway Motors, Inc. Internet advertisement: Steering Shaft Heim, 3/4" available at http://www.speedwaymotors.com/steel-heim-for-steering-shaft 3-4-16-RH-Male-757-Hole, 84.html.

YouTube, Inc. Internet advertisement: 360 degree rotating nail clipper, available at: http://www.youtube.com/watch?v=2H6xeGfD-BU.

* cited by examiner

HAND TOOL AND METHOD OF USING SAME

CROSS-REFERENCE TO RELATED APPLICATIONS

This application is a continuation-in-part of U.S. design application Ser. No. 29/467,935 filed concurrently on Sep. 25, 2013, which application is a continuation-in-part of International Application No. PCT/US2009/001442, filed Mar. 4, 2009 designating the United States and other countries, which is a continuation of U.S. application Ser. No. 12/137,482, filed Jun. 11, 2008, now U.S. Pat. No. 7,717,017 issued on May 18, 2010, the disclosures of which are hereby incorporated by reference in their entirety to provide continuity of disclosure to the extent such disclosures are not inconsistent with the disclosure herein.

FIELD OF THE INVENTION

This invention generally relates to tools and more particularly relates to hand tools and methods of manufacturing and using same.

BACKGROUND OF THE INVENTION

Conventional hand tools, such as conventional fingernail and toe nail clippers, have proven problematic to use, particularly when used by the elderly, arthritic individuals, stroke victims and others who have limited range of arm, wrist and hand movement.

More specifically, conventional fingernail and toe nail clippers have a spring handle that pivots about a fulcrum. Connected to the handle is a lever that is configured to downwardly press against the handle, so as to cause cutting edges formed on the handle to contact each other. However, the handle and lever must be in alignment with each other during the nail clipping operation to achieve efficient operation of the device. Movement of the handle and lever into alignment during the nail clipping operation requires extensive manipulation of the handle and lever and extensive dexterity on the part of the user. Such extensive manipulation and need for extensive dexterity is problematic for elderly persons, arthritic individuals, stroke victims and others having limited arm, wrist and hand movement.

As another example, with respect to surgical instruments, it is often necessary to perform surgery on difficult-to-reach areas of the human body without obstructing the surgeon's field of view. This is also true with respect to veterinarians who perform surgery on animals. Also, in the specific case of surgery, it is also often necessary for the surgeon to use one surgical instrument, such as scissors, to perform a clipping/cutting procedure on a body structure, while using another surgical instrument, such as forceps or clamps, to hold the body structure. These two surgical instruments typically have significantly different fixed configurations. Having to stock a multiplicity of surgical instruments in hospital inventory with significantly different fixed configurations for performing different surgical functions is inconvenient and costly.

As a further example, with respect to wire and bolt cutters, it is sometimes necessary to sever cables and bolts located in confined spaces and recesses. This may be necessary when performing machinery repair, remodeling/renovating buildings, rescue of persons trapped by fallen building structure and debris, and rescue of persons trapped in damaged automobiles due to a collision. Use of cable and bolt cutters having configurations with cutting edges in a permanent, fixed orientation can make such cutting operations more difficult.

Attempts have been made to address the considerations mentioned hereinabove with respect to the structure and use of hand tools. For example, U.S. Pat. No. 5,062,666 titled "Nail Clipper" issued Nov. 12, 1991, in the name of Jaw-Shiunn Tsay relates to an improved nail clipper.

According to the Tsay patent, the nail clipper comprises an elongate lever, a short upper body, a long lower body and a joint pin to assemble the lever and both the upper and the lower bodies together at their front sections, so that the lever can be pressed down to compress the upper body downward on the lower body. The nail clipper further comprises two opposed pairs of curved cutting edges provided on opposite sides of the upper and the lower bodies (see FIGS. 3, 4, 5 and 6 of the Tsay patent). The cutting edges are fixed at two positions, one position being perpendicular to the other position. This patent states that an advantage of the nail clipper is that the two pairs of cutting edges can easily clip nails on the other hand after finishing one hand.

However, the Tsay patent discloses that the cutting edges are fixed at two positions, one position being perpendicular to the other position. Fixing the cutting edges at two positions may nonetheless require a user to extensively manipulate the nail clipper to clip nails. Requiring the user to extensively manipulate the nail clipper to clip nails is inconvenient for the user.

Another attempt to address the considerations mentioned hereinabove with respect to the structure and use of hand tools is disclosed in U.S. Pat. No. 3,742,957 titled "Surgical Clamp" issued Jul. 3, 1973, in the name of Jack H. White. The White patent relates to surgical and like clamps.

According to the White patent, a clamp includes a set of jaws including a gripping portion and an actuating portion and pin means pivotally connecting the jaws for movement between open and closed positions within a first plane. A set of handles comprising crank arms are disposed and operable between the open and closed positions within a second plane. The second plane is mutually intersecting with the first plane and the crank arms are connected to the actuating portion of the jaws at the junctures of respective leg portions of the crank arms. As mentioned in the White patent, this connection comprises a hinge for infinite angular positioning of the first plane containing the jaws with respect to the second plane containing the crank arms. Also, the leg portions of the crank arms are pivotally joined as by a pin, which in the illustrated embodiment comprises a screw, to provide for opening and closing movement of the handles.

However, the White patent discloses that opening and closing movement of the handles is accomplished by adjustment of a screw (i.e., pin) that joins the handles. Only allowing opening and closing movement of the handles by means of a screw creates unnecessary delay in adjusting the clamp before surgery, readjusting the clamp during surgery, if necessary, and releasing the clamp after surgery because a screw driver is apparently needed to adjust the screw. Such a delay before, during and after a surgical procedure is undesirable.

Another attempt to address the considerations mentioned hereinabove with respect to the structure and use of hand tools is disclosed in U.S. Pat. No. 2,020,242 titled "Swivel Head Tool" issued Nov. 5, 1935, in the name of G. W. Geddes. The Geddes patent relates to tools in which the jaws may be placed in various angular positions relative to an operating handle system.

According to the Geddes patent, a bolt clipper embodying a jaw lever system and an actuating handle lever system are provided. The jaw levers can be adjusted to various angular positions relative to the plane of the handle levers so as to permit operating swinging movement of the jaws. For this purpose, joints embody mating spherical surfaces and tail portions of the jaw levers are provided with shallow recesses of spherical contour, which receive interposed balls on which at least of one of the parts turns (see column 2, lines 15-37 of the Geddes patent). This patent also discloses that handle members are apparently pivotally mounted by means of a screw-like pin.

However, although the Geddes patent discloses handle members that are pivotally mounted, this patent apparently requires adjustment of a screw-like pin in order to return the handle members to their default position. Requiring adjustment of the screw-like pin in order to return the handle members to their default position is inconvenient for the user because a screw driver is apparently needed to adjust the screw-like pin.

Although the approaches recited hereinabove disclose various configurations of hand tools, the approaches recited hereinabove do not appear to disclose the invention described and claimed hereinbelow.

SUMMARY OF THE INVENTION

The present invention addresses the shortcomings of the prior art approaches mentioned hereinabove by providing a suitable hand tool, and method of manufacturing and using same.

According to a first embodiment of the present invention, the hand tool comprises a handle assembly that, in use, is oriented in a y-axis plane. The handle assembly is sized and contoured to be manipulated by hand. In this regard, the handle assembly includes a generally smooth, arcuate-shaped upper handle member and a generally smooth, arcuate-shaped lower handle member disposed opposite the upper handle member. In this manner, the upper handle member and the lower handle member are disposed in the same y-axis plane for grasping by the user. In addition, the upper handle member and the lower handle member are pivotally linked or pivotally joined together by a linkage bolt that allows pivoting action of the handle members in the y-axis plane. That is, the upper and lower handle members pivot toward each other to a closed position when the user grasps and simultaneously applies manual pressure to the upper and lower handle members. A biasing member, which may be in the form of a leaf spring, is interposed between the handle members for automatically biasing the handle members away from each other in order to return the handle members to their default open position after hand pressure is released.

The hand tool also comprises a coupler assembly including an upper coupler and a lower coupler. The upper coupler includes an articulating upper heim joint and the lower coupler includes an articulating lower heim joint. The upper heim joint is connected to the upper handle member and the lower heim joint is connected to the lower handle member. The upper and lower heim joints are each provided with threaded shanks for threadably engaging their respective upper and lower handle members. In this manner, the upper and lower heim joints are fixedly attached to their respective upper and lower handle members. As known in the art, a heim joint (i.e., also referred to in the art as a rose joint, rod end bearing, or heim bearing) allows multi-directional, such as side-to-side (i.e., rotational or swiveling), and tilting, substantially frictionless movement of a component connected to it without breaking of the component.

As contemplated by the invention, a component comprising a tool head is connected to the upper and lower heim joints. The tool head can be fingernail or toe nail clipper blades, surgical clamp jaws, bolt cutter blades or other tool head. For example, with respect to blade tools (e.g., fingernail or toe nail clippers, bolt cutters), the tool head comprises an upper blade tool pivotally connected to the upper heim joint and a lower blade tool pivotally connected to the lower heim joint. A pivot pin joins the upper blade tool and the lower blade tool. In this manner, the pivot pin, upper heim joint and lower heim joint cooperate to allow simultaneous side-to-side (i.e., rotational or swiveling) movement of the upper and lower blade tools in addition to allowing closing and opening of the blade tools. The user manually moves the blade tools to a desired side-to-side (i.e., rotated, swiveled) and/or tilted orientation for operating on a work piece. When the user grasps and simultaneously applies manual pressure to the upper and lower handle members, the upper and lower handle members pivot toward each other and lock in position. As the upper and lower handle members pivot toward each other, the upper and lower blade tools also pivot toward each other due to the previously mentioned interconnection of the blade tools with the handle members. As the upper and lower blade tools pivot toward each other in this manner, the upper blade tool and the lower blade tool close. Conversely, as manual pressure is released, the upper and lower handle members automatically pivot away from each other due to presence of the biasing member interposed between them. Thus, as the upper and lower handle members pivot away from each other, the upper blade tool and the lower blade tool open, which is the default position of the device. In this manner, manual actuation of the handle members in cooperation with the heim joints that interconnect the tool head assembly and the handle assembly allow opening and closing of the upper and lower blade tools.

The upper and lower heim joints allow their respective upper and lower blade tools to swivel or rotate side-to-side at least 180 degrees in the x-plane and tilt a limited amount (e.g., about 30°) in the x and y axes planes in order to conveniently position the upper and lower blade tools at a desired location on the work piece. As previously mentioned, means are provided for locking the angular (i.e., rotational, swivel or side-to-side) and tilted position of the upper and lower blade tools. In other words, once the upper and lower blade tools are positioned at the desired location on the work piece, the handle members are closed in order to lock the upper and lower blade tools in their angular position and to actuate the upper and lower blade tools, so that the upper and lower blade tools close, as previously mentioned, to cut the work piece.

Thus, the upper blade tool, lower blade tool, pivot pin, upper heim joint, and lower heim joint cooperate to allow the upper blade tool and lower blade tool to simultaneously swivel or rotate at least 180 degrees in the x-axis plane and tilt a limited amount (i.e., about 30°) in the x and y axes planes for positioning the upper blade tool and lower tool at the desired location for operating on the work piece.

In this first embodiment of the invention, the tool head is detachable from the heim joints by means described in detail hereinbelow. This allows decoupling of the tool head from the heim joints, so that different types of tool heads and various sizes of the same type of tool head can be interchanged. Also, providing for detachment or decoupling of the tool head from the heim joints allows replacement of a worn tool head. Thus, the hand tool of the present invention is versatile and accommodates tool heads required for different applications.

Therefore, the 180 degree rotational (i.e., swivel) feature and the tilting feature allow the hand tool of the first embodiment of the invention to obtain a variable angle of attack on a work piece. Obtaining such a variable of attack allows the hand tool to be conveniently manipulated in a manner that is particularly useful for elderly persons, arthritic individuals, stroke victims and others who have a limited range of arm, wrist and hand movement. The variable angle of attack also allows the hand tool to be conveniently manipulated in a manner that is particularly useful for performing surgical procedures on structures located in difficult-to-reach areas of the human body without obstructing the surgeon's field of view. In addition, the variable angle of attack allows the hand tool to be conveniently manipulated in a manner for cutting cables and bolts located in difficult to access, confined spaces.

A second embodiment of the invention is strictly in the form of a fingernail or toe nail clipper and has some features similar to the features of the first embodiment of the invention. In this regard, the second embodiment of the invention comprises a pair of handle members each including a relatively thin, arcuate-shaped outer shell matingly mounted on an arcuate-shaped inner supporting frame member. The outer shell covers the frame member, so that the frame member is not substantially visible. The outer shell may be formed from an aesthetically pleasing, decorative polymer plastic material, or other aesthetically pleasing material, and the frame member may be a light weight metal, metal alloy or other light-weight composition, so that the nail clipper may be easily carried in pocket or purse. Pair of oppositely disposed, pivotable cutting edges are interposed between distal end portions of the handle members and are generally concealed from view by the distal end portions of the handle members when viewed from the top or bottom of the device. A pair of heim joints interconnects respective ones of the pair of handle members with respective ones of the pair of cutting edges. The heim joints allow side-to-side rotational or swiveling movement of the cutting edges through an angle of about 180°. The upper handle member and the lower handle member are pivotally joined together by a pivot pin that allows pivoting action of the handle members in the y-axis plane. The upper and lower handle members pivot toward each other to a closed position when the user grasps and simultaneously applies manual pressure to the upper and lower handle members. The cutting edges are simultaneously locked in position and cut the fingernails or toe nails of the user when hand pressure is applied to close the handle members. A biasing member, which may be in the form of a torsion spring, is interposed between the handle members for biasing the handle members to their open default position when hand pressure is released by the user.

Therefore, the 180 degree side-to-side (i.e., rotational or swivel) movement feature of the cutting edges belonging to this second embodiment of the invention allows the device to obtain a variable angle of attack, so that fingernails and toe nails can be conveniently clipped by elderly persons, arthritic individuals, stroke victims and others who have a limited range of arm, wrist and hand movement.

According to an aspect of the present invention, there is provided a hand tool comprising a handle assembly oriented in a first plane and sized for hand manipulation; a tool head assembly coupled to the handle assembly for operating on a work piece in response to hand manipulation of the handle assembly; and at least one heim joint coupler interconnecting the handle assembly and the tool head assembly for rotating the tool head assembly to a selected angle relative to the handle assembly.

According to another aspect of the present invention, there is provided a hand tool, comprising: a handle assembly including a pair of handles oriented in a first plane and sized for hand manipulation; a tool head assembly coupled to the handle assembly for operating on a work piece in response to hand manipulation of the pair of handles; and at least one heim joint coupler interconnecting the handle assembly and the tool head assembly for rotating the tool head assembly to a selected angle relative to the handle assembly, so that the tool head assembly is oriented to operate on the work piece at the selected angle.

According to yet another aspect of the present invention there is provided a method of manufacturing a hand tool, comprising the steps of: providing a handle assembly; coupling a tool head assembly to the handle assembly; and interconnecting the handle assembly and the tool head assembly to at least one heim joint coupler.

A feature of the present invention is the provision of a tool head assembly coupled to a handle assembly for operating on a work piece in response to hand manipulation of the handle assembly, the tool head assembly being adapted to operate on the work piece at a selected angle.

Another feature of the present invention is the provision of at least one heim joint coupler interconnecting the handle assembly and the tool head assembly.

In addition to the foregoing, various other method and/or device aspects and features are set forth and described in the teachings, such as text (e.g., claims and/or detailed description) and/or drawings of the present invention.

The foregoing is a summary and thus may contain simplifications, generalizations, inclusions, and/or omissions of detail. Consequently, those skilled in the art will appreciate that the summary is illustrative only and is not intended to be in any way limiting. In addition to the illustrative aspects, embodiments, and features described hereinabove, further aspects, embodiments, and features will become apparent by reference to the drawings and the following detailed description.

BRIEF DESCRIPTION OF THE DRAWING

The invention will be more fully understood by reference to the detailed description in conjunction with the following figures, wherein.

DETAILED DESCRIPTION OF PREFERRED EMBODIMENTS

Figure 1:
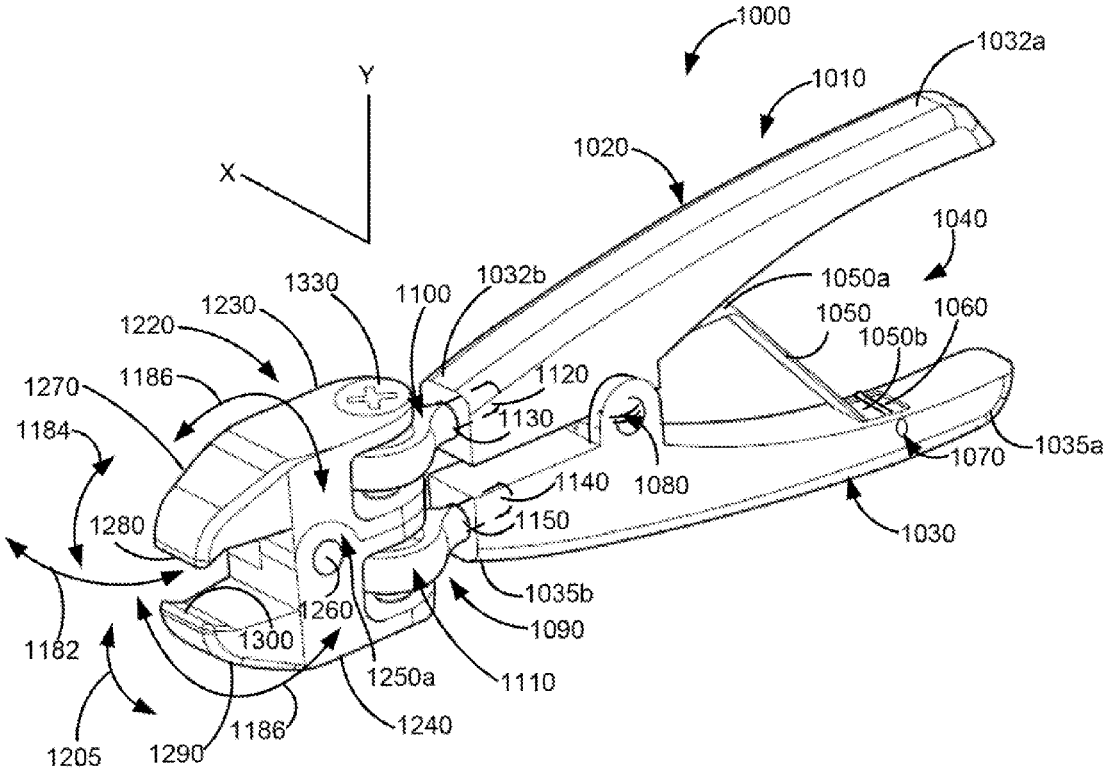
FIG. 1 is a view in perspective of a first embodiment hand tool including a first embodiment tool head assembly configured as a fingernail or toe nail clipper.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from either the spirit or scope of the invention.

In addition, the present patent specification uses formal outline headings for clarity of presentation. However, it is to be understood that the outline headings are for presentation purposes, and that different types of subject matter may be discussed throughout the application (e.g., device(s)/structure(s) may be described under process(es)/operations heading(s) and/or process(es)/operations may be discussed under structure(s)/process(es) headings; and/or descriptions of single topics may span two or more topic headings). Hence, the use of the formal outline headings is not intended to be in any way limiting.

Figure 2:
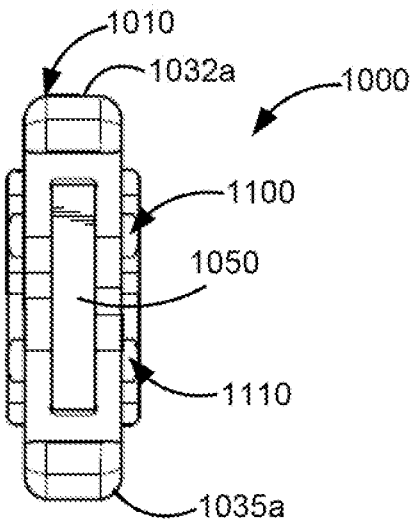
FIG. 2 is a rear view in elevation of the first embodiment hand tool.
Figure 3:
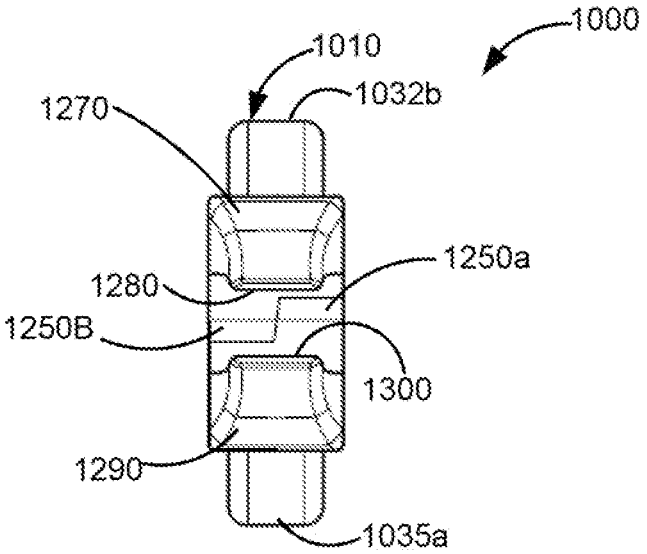
FIG. 3 is a front view in elevation of the first embodiment hand tool.
Figure 4:
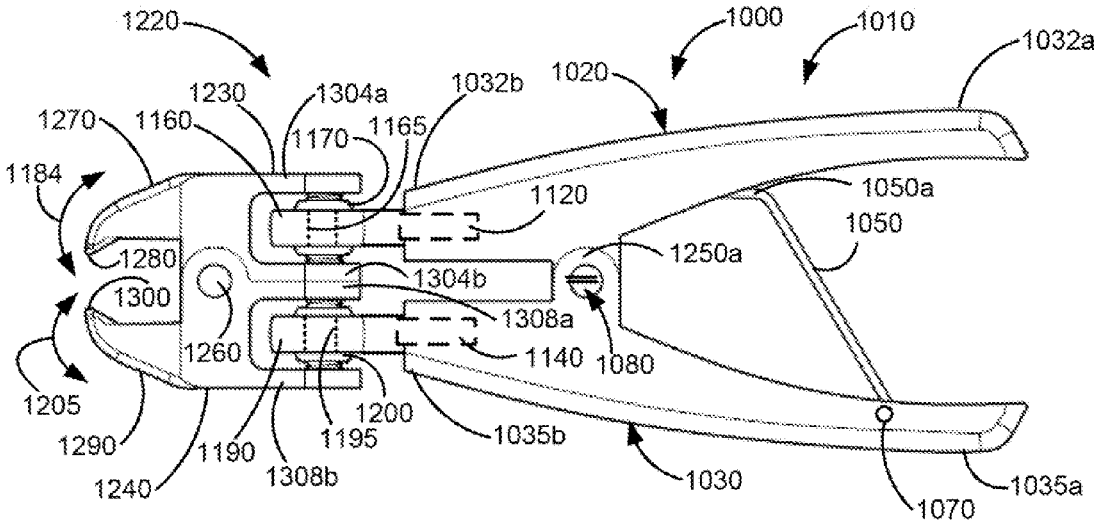
FIG. 4 is a right side view in elevation of the first embodiment hand tool.
Figure 4A:
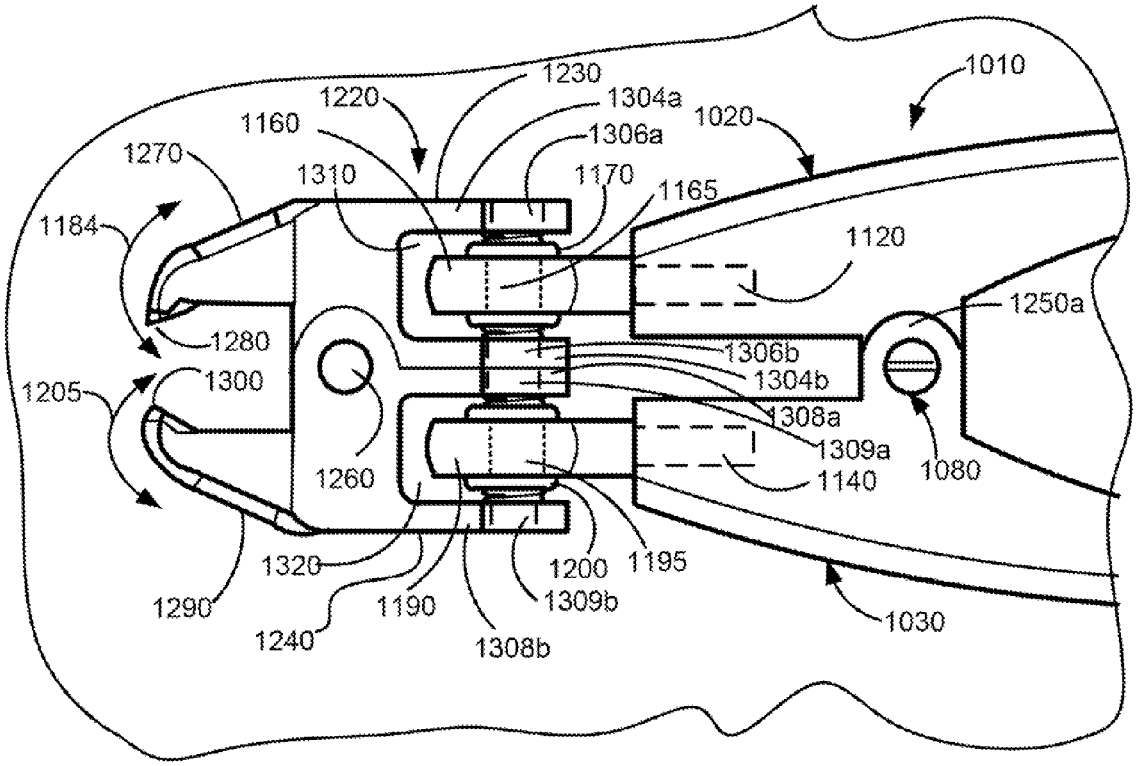
FIG. 4A is a fragmentary view in elevation of the right side of the first embodiment hand tool.

Therefore, with reference to FIGS. 1, 2 and 3, there is shown a first embodiment hand tool, generally referred as 1000, for operating on a work piece (not shown). In the exemplary embodiment illustrated, hand tool 1000 is a fingernail or toe nail clipper for clipping or cutting fingernails and toe nails of a user (also not shown). However, it will be appreciated that hand tool 1000 is not limited to the configuration of a fingernail or toe nail clipper. Rather, hand tool 1000 may be in the configuration of other types of hand tools, as well, such as clamps and bolt cutters.

Referring again to FIGS. 1, 2 and 3, hand tool 1000 comprises a first embodiment hand held tool mount or handle assembly 1010 shown oriented in a y-axis or first plane. Handle assembly 1010, which is sized for hand manipulation or grasping by the user, includes a generally smooth, contoured, arcuate-shaped upper handle member 1020 and a generally smooth, contoured, arcuate-shaped lower handle member 1030 disposed in the first plane opposite upper handle member 1020. The contoured or arcuate shape of upper handle member 1020 and lower handle member 1030 facilitates grasping thereof by the user of hand tool 1000. Upper handle member 1020 defines a proximal end portion 1032*a* and a distal end portion 1032*b* for reasons recited hereinbelow. Similarly, lower handle member 1030 defines a proximal end portion 1035*a* and a distal end portion 1035*b* for reasons recited hereinbelow. The handle assembly 1010 is also provided with a resilient biasing member in the form of an elongate leaf spring 1040 for reasons provided hereinbelow. In this regard, leaf spring 1040 has a unitary construction that includes a central straight segment portion 1050, which is disposed between an upper straight portion 1050*a* and a lower rounded or curved end portion 1050*b*. Upper straight portion 1050*a* is positioned generally intermediate proximal end portion 1032*a* and distal end portion 1032*b* of upper handle member 1020. Lower rounded or curved end portion 1050*b* is positioned generally intermediate proximal end portion 1035*a* and distal end portion 1035*b* of lower handle member 1030.

Figure 5:
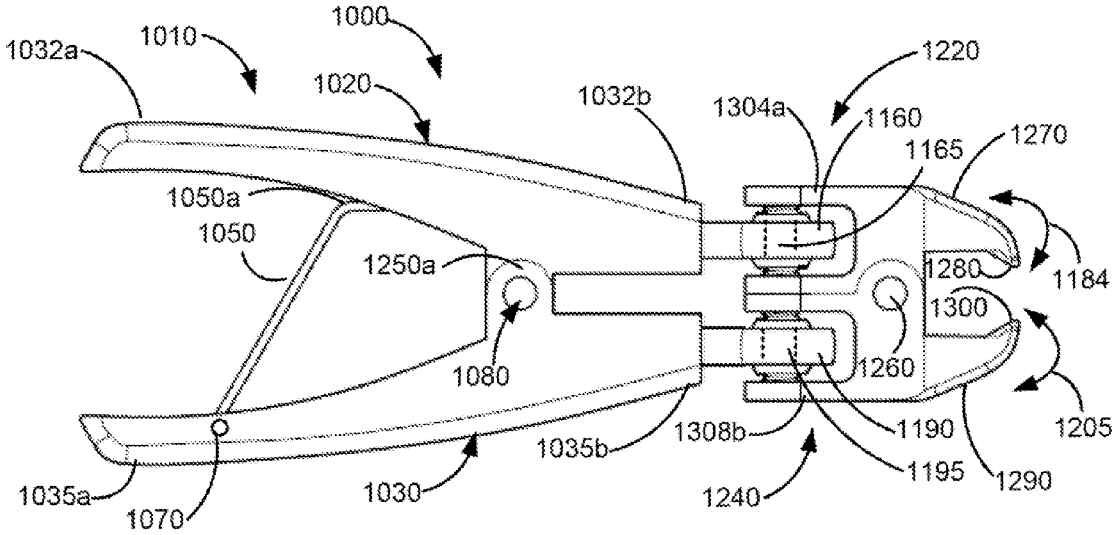
FIG. 5 is a left side view in elevation of the first embodiment hand tool, the first embodiment hand tool being shown in an open position.
Figure 5A:
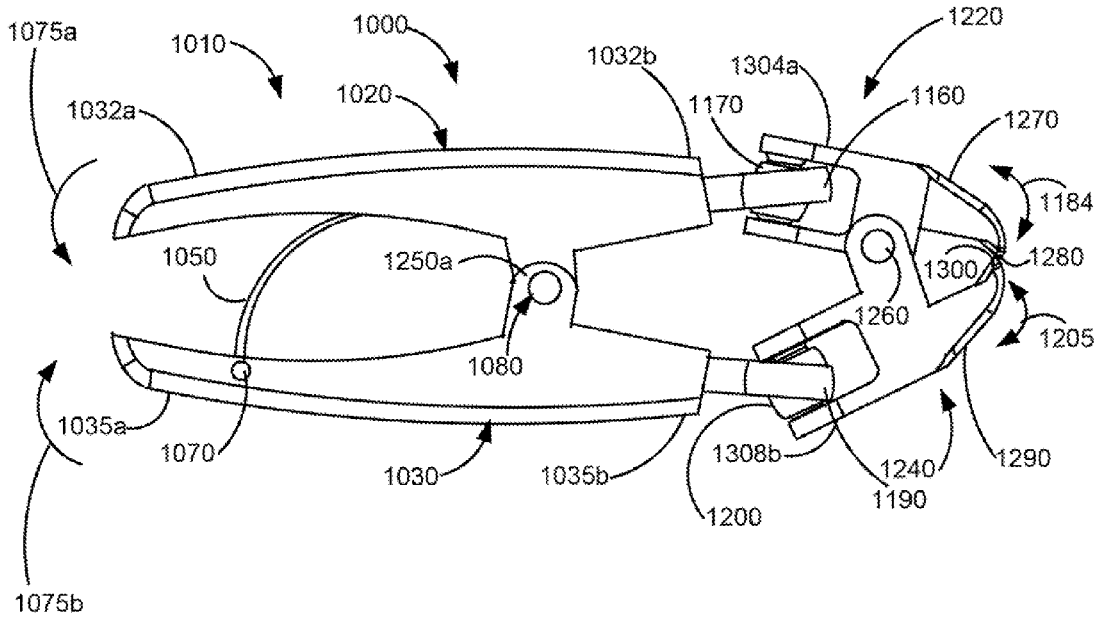
FIG. 5A is a left side view in elevation of the first embodiment hand tool, the first embodiment hand tool being shown in a closed position.
Figure 6:
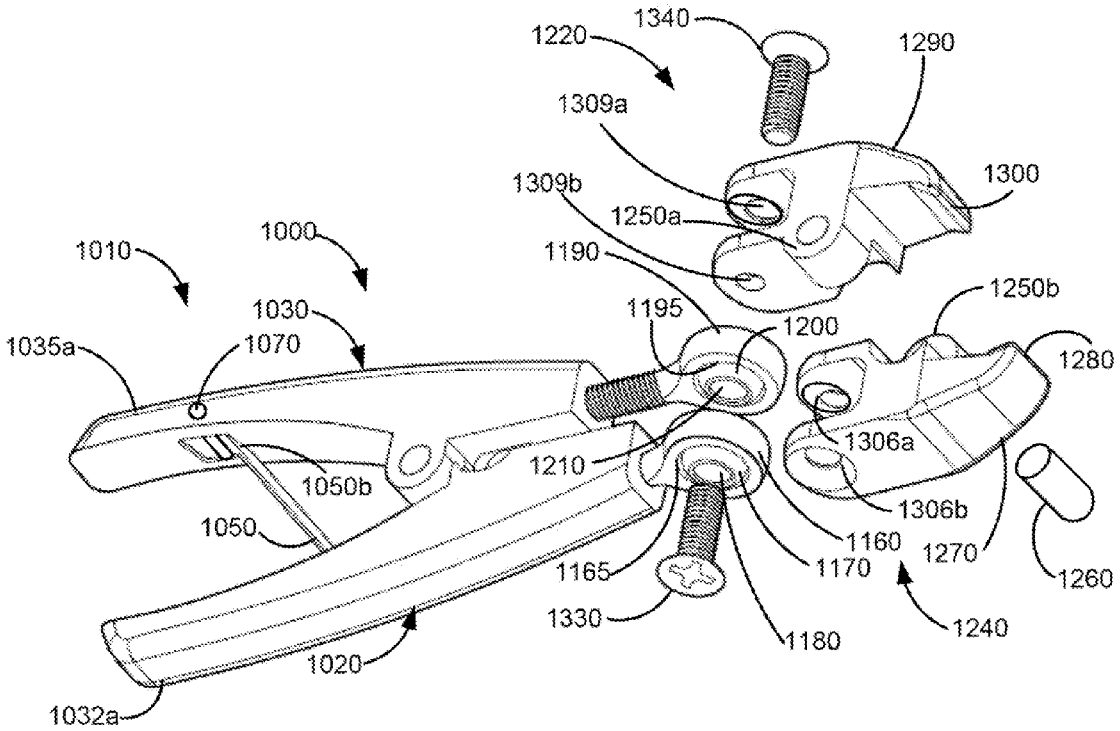
FIG. 6 is a partially exploded view of the first embodiment hand tool.

Still referring to FIGS. 1, 2 and 3, in order to hold the handle members 1020/1030 apart, lower rounded or curved end portion 1050*b* of leaf spring 1040 is mounted within a lower handle member cutout 1060 by a mounting or spring pin indicated generally at 1070. Cutout 1060 is disposed at an inner rearward surface area of lower handle member 1030 in a manner that allows leaf spring 1040 to be disposed at an inclined angle between upper handle member 1020 and lower handle member 1030. The opposite end of leaf spring 1040, which terminates in upper straight portion 1050*a*, permits the opposite or upper straight portion 1050*a* to rest in engagement with an inner surface area of upper handle member 1020. In short, leaf spring 1040 is wedged between upper handle member 1020 and lower handle member 1030 to provide a return force when the two handle members 1020/1030 are manually squeezed together by the user, such as in the direction of directional arrows 1075*a* and 1075*b* (see FIG. 5A).

Referring again to FIGS. 1, 2, and 3, upper handle member 1020 and lower handle member 1030 are pivotably connected to each other on an axis defined by a mounting or linkage bolt 1080 and are held apart from one another, in a default position, by the previously mentioned leaf spring 1040. Linkage bolt 1080 therefore facilitates holding the two handle members 1020/1030 pivotally together. The previously mentioned return force is a force sufficient to cause the two handle members 1020/1030 to move pivotally away from one another about the axis defined by mounting or linkage bolt 1080 when handle members 1020/1030 are released by the user, so that handle members 1020/1030 return to their default or open positions as best seen in FIG. 1. Although leaf spring 1040 of a particular configuration is illustrated, it should be understood by those skilled in the art that other suitable biasing or spring means may be utilized, such as a coiled compression spring (not shown) or other suitable spring means.

As shown in FIGS. 1, 2 and 3, hand tool 1000 further includes a heim joint coupler assembly [THE HANDLE ASSEMBLY WAS ALREADY CALLED A TOOL MOUNT] indicated generally at 1090. The coupler assembly 1090 includes an upper mount or upper coupler in the form of an articulating upper heim joint 1100. Coupler assembly 1090 further includes a lower mount or lower coupler in the form of an articulating lower heim joint 1110, [WHEN YOU ARE GOING TO DESCRIBE DIFFERENT ASSEMBLY COMPONENTS YOU SHOULD SEPARATE THE REFERENCE CHARACTERS BY AT LEAST 100 UNITS—THIS ALLOWS YOU TO KEEP UPPER ASSEMBLY COMPONENT TOGETHER AND LOWER ASSEMBLY COMPONENT TOGETHER WHICH ALSO ALLOWS THE DRAWING PARTS TO BE MORE EASILY IDENTIFIED] Upper heim joint 1100 is threadably attached to distal end portion 1032*b* of upper handle member 1020 by means of an elongate, externally threaded upper shank portion 1120 that is received in an internally threaded upper bore or hole 1130 formed in distal end portion 1032*b*. Similarly, lower heim joint 1110 is threadably attached to distal end portion 1035*b* of lower handle member 1030 by means of an elongate, externally threaded lower shank portion 1140 that is received in an internally threaded lower bore or hole 1150 formed in distal end portion 1035*b*. Thus, upper shank portion 1120 is threadably received in upper hole 1130 and lower shank portion 1140 is threadably received in lower hole 1150 for coupling shank portions 1120/1140 to handle members 1020/1030, respectively. However, shank portions 1120/1140 and holes 1130/1150 need not be threaded; rather, shank portions 1120/1140 and holes 1130/1150 may be smooth and sized for allowing coupling of shank portions 1120/1140 to handle members 1020/1030 by means of a press-fit.

Referring to FIGS. 1, 4, 4A, 5, 5A and 6, upper heim joint 1100 comprises an annular upper casing 1160 integrally attached to upper shank portion 1120. Upper casing 1160 defines an opening 1165 therethrough for reasons provided hereinbelow. In addition, upper casing 1160 may have a generally spherical interior (not shown) contoured for slidably, matingly receiving a spherical upper ball swivel 1170, such that upper ball swivel 1170 is slidably retained within upper casing 1160. Upper ball swivel 1170 defines an upper ball hole 1180 (see FIG. 6) centrally therethrough for reasons provided hereinbelow. In this manner, upper ball swivel 1170 is capable of multi-directional, slidable movement within upper casing 1160. In other words, upper ball swivel 1170 is capable of side-to-side, rotational, or swivel movement in the horizontal x-axis plane as illustrated by directional arrow 1182 (see FIG. 1). In addition, upper ball swivel 1170 is capable of tilting movement in the y-axis plane as illustrated by directional arrow 1184 (see FIGS. 1 and 5A) as well as tilting movement in the x-axis plane as illustrated by directional arrow 1186 (see FIG. 1).

Referring again to FIGS. 1, 4, 4A, 5, 5A and 6, lower heim joint 1110 comprises an annular lower casing 1190 integrally attached to lower shank portion 1140. Lower casing 1190 defines a lower casing opening 1195 therethrough for reasons provided hereinbelow. In addition, lower casing 1190 may have a generally spherical interior (not shown) contoured for slidably, matingly receiving spherical lower ball swivel 1200, such that lower ball swivel 1200 is slidably retained within lower casing 1190. Lower ball swivel 1200 defines a lower ball hole 1210 (see FIG. 6) centrally therethrough for reasons provided hereinbelow. In this manner, lower ball swivel 1200 is capable of multi-directional, slidable movement within lower casing 1190. In other words, lower ball swivel 1200 is capable of side-to-side, rotational, or swivel movement in the horizontal x-axis plane as illustrated by previously mentioned directional arrow 1182 (see FIG. 1). In addition, lower ball swivel 1200 is capable of tilting movement in the y-axis plane as illustrated by directional arrow 1205 (see FIGS. 1 and 5A) as well as tilting movement in the x-axis plane as illustrated by previously mentioned directional arrow 1186 (see FIG. 1). As described fully hereinbelow, it will be appreciated that ball swivels 1170/1200 will rotate and tilt in unison as will be explained in greater detail hereinafter.

Referring to FIGS. 1, 3, 4, 4A, 5, 5A and 6, to provide hand tool 1000 with the functionality noted hereinabove, hand tool 1000 further includes a replaceable, first embodiment tool head assembly, generally referred to as 1220, for clipping fingernails and toe nails of the user of hand tool 1000. In other words, tool head assembly 1220, which is coupled to handle assembly 1010 by means of coupler assembly 1090, is capable of operating on (i.e., clipping) the fingernails and toe nails (i.e., the work piece) of the user in response to hand manipulation of handle assembly 1010, as described in detail presently. In this regard, tool head assembly 1220 generally includes an upper tool member 1230 and a lower tool member 1240 both disposed in the y-axis plane, lower tool member 1240 being oriented opposite to and coincident with upper tool member 1230. Lower tool member 1240 includes a lower tool member [IT IS ALWAYS BETTER TO USE NAMES AS OPPOSED TO FIRST, SECOND, ETC.] pivoting portion 1250*a* and upper tool member 1230 includes an upper tool member pivoting portion 1250*b* (see FIG. 3). The lower tool member pivoting portion 1250*a* and upper tool member pivoting portion 1250*b* are pivotably interconnected by a pivot pin 1260. Thus, the pivotable interconnection of first pivoting portion 1250*a* and second pivoting portion 1250*b* allow lower tool member 1240 and upper tool member 1230 to pivot about pivot pin 1260 for reasons provided hereinbelow.

Referring yet again to FIGS. 1, 4, 4A, 5, 5A and 6, upper tool member 1230 has a unitary construction and includes an upper jaw 1270 in the form of an upper blade tool having an upper tool elongate front cutting edge portion 1280. Similarly, lower tool member 1240 has a unitary construction and includes a lower jaw 1290 opposite upper jaw 1270. The lower jaw 1290 is in the form of a lower blade tool having a lower tool elongate front cutting edge portion 1300. Fingernails and toe nails of the user are clipped or cut when cutting edge portions 1280/1300 are brought to bear against each in the manner described hereinbelow.

Still referring to FIGS. 1, 4, 4A, 5, 5A and 6, upper tool member 1230 includes an upper arm portion 1304*a* and a lower arm portion 1304*b*. Lower arm portion 1304*b* is disposed opposite of and coincident with upper arm portion 1304*a*. Upper arm portion 1304*a* defines an internally threaded upper arm bore 1306*a* therethrough and lower arm portion 1304*b* defines an internally threaded lower arm bore 1306*b* therethrough (see FIG. 4A), upper arm bore 1306*a* and lower arm bore 1306*b* are aligned with previously mentioned upper ball hole 1180 defined by the upper ball swivel 1170. Similarly, lower tool member 1240 includes a third or another upper arm portion 1308*a* and a fourth or another lower arm portion 1308*b*. The lower tool member lower arm portion 1308*b* is disposed opposite of and coincident with the lower tool member upper arm portion 1308*a*. The lower tool upper arm portion 1308*a* defines an internally threaded lower tool upper arm bore 1309*a* therethrough and lower tool lower arm portion 1308*b* defines an internally threaded lower tool lower arm bore 1309*b* therethrough (see FIG. 4A). The lower tool lower arm bore 1309*a* and the lower tool upper arm bore 1309*b* are aligned with previously mentioned lower ball hole 1210 defined by lower ball swivel 1200. Moreover, upper arm portion 1304*a* and lower arm portion 1304*b* of the upper tool member 1230 are spaced apart, so as to define a space 1310 therebetween for receiving upper heim joint 1100 thereinto. Similarly, upper arm portion 1308*a* and lower arm portion 1308*b* of the lower tool member 1240 are space apart, so as to define another space 1320 therebetween for receiving lower heim joint 1110 thereinto. Spaces 1310 and 1320 are sized to accommodate presence of heim joints 1100/1110 therein and allow tool head assembly 1220 to freely rotate in the x-axis plane without obstruction. In this regard, it will be appreciated by those skilled in the arm that ball swivels 1170/1200 will rotate and tilt in unison and to a like extent due to their interconnection by means of the upper tool member 1230, the lower tool member 1240 and the pivot pin 1260 (see FIGS. 1,4, 4A, 5 and 5A).

Although not critical, it is nonetheless important that tool head assembly 1220 be detachably coupled to coupler assembly 1090, so that different types of tool head assemblies 1220 and various sizes of the same type of tool head assembly 1220 can be interchanged. Also, providing for detachment of tool head assembly 1220 from coupler assembly 1090 allows replacement of a worn tool head assembly 1220. Thus, hand tool 1000 is versatile and accommodates tool head assemblies required for different applications.

Referring again to FIGS. 1, 4, 4A, 5, 5A and 6, the manner in which tool head assembly 1220 is detachably coupled to coupler assembly 1090 will now be described. In this regard, an upper connecting member, such as externally threaded upper tool screw-bolt 1330 (see FIG. 6), is caused to threadably engage internally threaded upper arm bore 1306*a* and internally threaded lower arm bore 1306*b* as upper tool screw-bolt 1330 extends through upper arm bore 1306*a*, upper ball hole 1180 defined by upper ball swivel 1170 and into lower arm bore 1306*b*. In this manner, upper heim joint 1100 is retained within space 1310 as upper tool member 1230 rotates and/or tilts.

Similarly, a lower connecting member, such as externally threaded lower tool screw-bolt 1340, is caused to threadably engage internally threaded lower arm bore 1309*b* and internally threaded upper arm bore 1309*a* as lower tool screw-bolt 1340 extends through upper arm bore 1309*b*, lower ball hole 1210 defined by lower ball swivel 1200 and into upper arm bore 1309*a*. In this manner, lower heim joint 1110 is retained within space 1320 as lower tool member 1240 rotates and/or tilts. Also, in this manner, upper tool member 1230 and lower tool member 1240 are detachably coupled to upper heim joint 1100 and lower heim joint 1110, respectively, due to use of screw bolts 1330/1340. It should be appreciated that upper tool member 1230 and lower tool member 1240 will rotate and tilt in unison and to a like extent due to their interconnection by means of pivot pin 1260 and due to use of upper screw-bolt 1330 and lower screw-bolt 1340, as described hereinabove. Detaching or decoupling of upper tool member 1230 and lower tool member 1240 from upper heim joint 1100 and lower heim joint 1110, respectively, is accomplished by reversing the above-described steps for coupling upper tool member 1230 and lower tool member 1240 to upper heim joint 1100 and lower heim joint 1110.

As previously indicated, movement of tool head assembly 1220 is multi-directional because tool head assembly 1220 is adapted to rotate or swivel in the x-axis plane and tilt in both the x-axis and y-axis planes. Such rotation and tilting is provided by presence of upper ball swivel 1170 that belongs to upper heim joint 1100 and lower ball swivel 1200 that belongs to lower heim joint 1110. However, for the sake of brevity, the description hereinbelow is directed only to rotation or swiveling of tool head assembly 1220 in the x-axis plane, it being understood that tool head assembly 1220 is adapted to swivel and tilt in the x-axis plane and only tilt in the y-axis plane.

Figure 7:
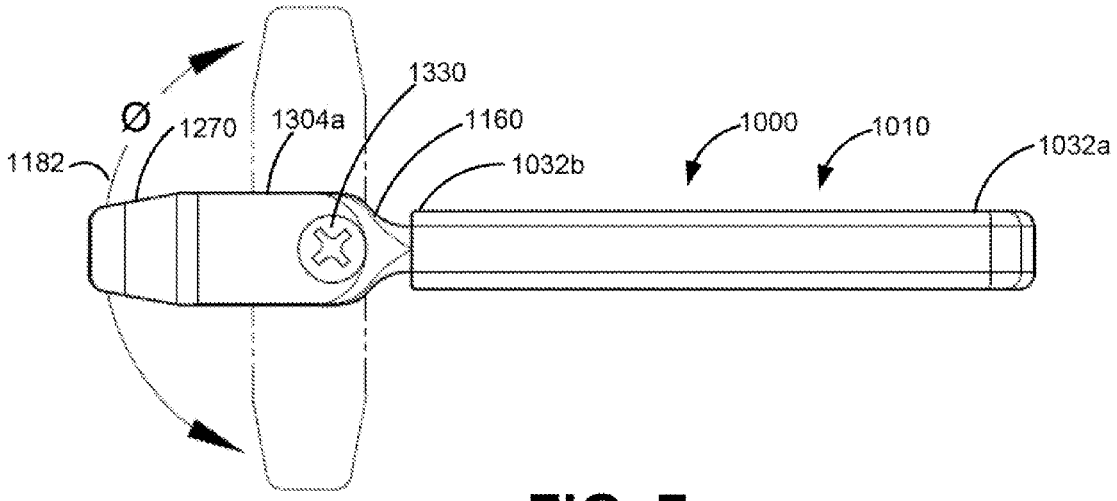
FIG. 7 is a top plan view of the first embodiment hand tool.
Figure 8:
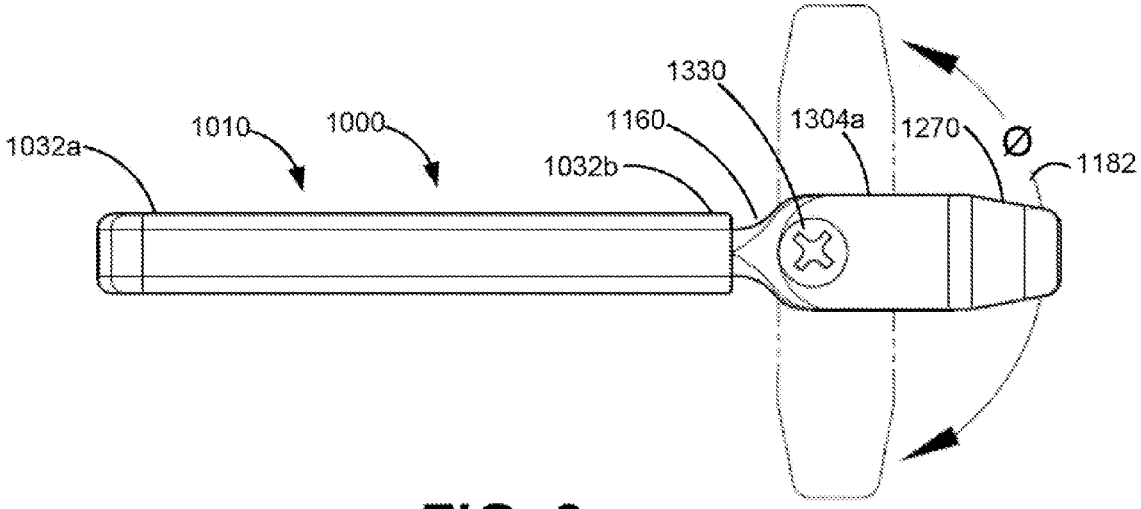
FIG. 8 is a bottom plan view of the first embodiment hand tool.

Therefore, referring to FIGS. 1, 7 and 8, tool head assembly 1220 is adapted to move side-to-side (i.e., rotate or swivel) in the x-axis plane to a user selected angle less than or equal to an angle theta "Ø" of about 180 degrees. Tool head assembly 1220 is capable of rotating in the x-axis plane due to presence of upper ball swivel 1170 and lower ball swivel 1200, as previously mentioned. Such side-to-side, rotational or swiveling movement of tool head assembly 1220 in the x-axis plane is accomplished by hand.

Figure 9:
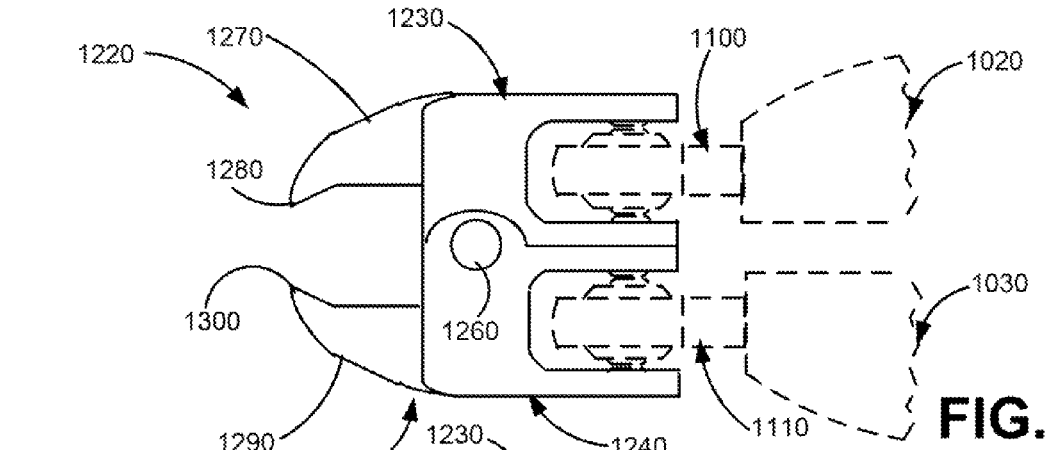
FIG. 9 is a right side view in elevation of a detached first embodiment tool head assembly configured as a fingernail or toe nail clipper.
Figure 10:
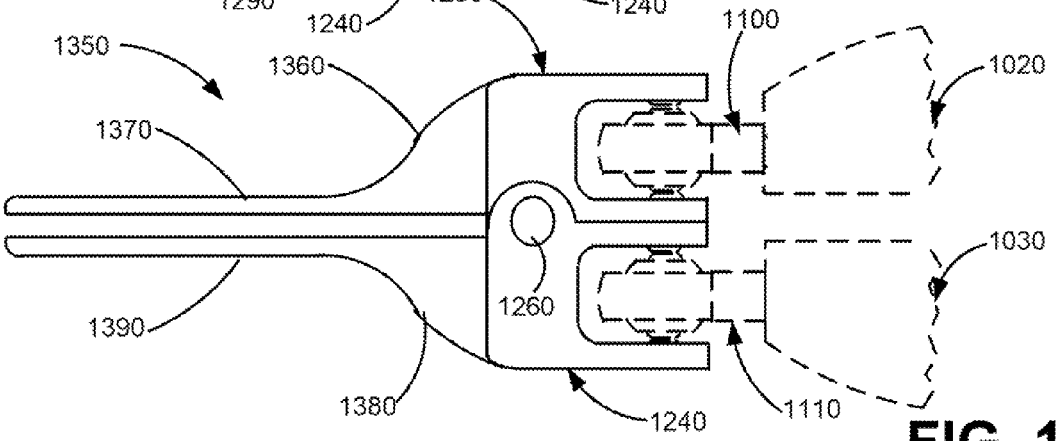
FIG. 10 is a right side view in elevation of a detached second embodiment tool head assembly configured as a surgical clamp.
Figure 11:
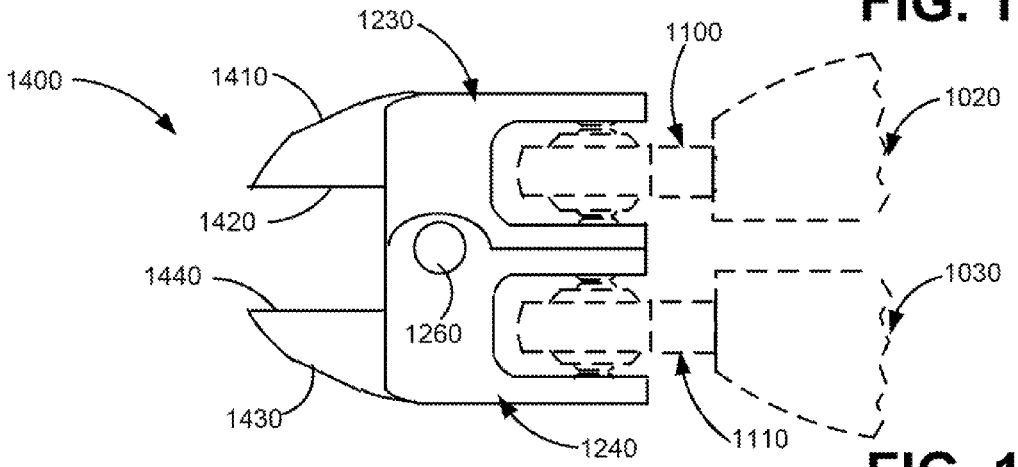
FIG. 11 is a right side view in elevation of a detached third embodiment tool head assembly configured as a cable/bolt cutter.

Turning now to FIGS. 9, 10 and 11, various tool head assembly embodiments are there shown. As previously mentioned, detachable first embodiment tool head assembly 1220 comprises upper jaw 1270 having upper tool front cutting edge 1280 and lower jaw 1290 having lower tool front cutting edge 1300 for cutting or clipping fingernails or toe nails of the user when upper tool cutting edge 1280 and lower tool front cutting edge 1300 are brought to bear against each other.

A detachable second embodiment tool head assembly, generally referred to as 1350, comprises an upper jaw 1360 having an upper jaw clamping extension 1370 and a lower jaw 1380 having a lower jaw clamping extension 1390. Upper jaw 1360 and lower jaw 1380 of second embodiment tool head assembly 1350 are capable of pivoting about pivot pin 1260 in a manner substantially similar to the pivoting action of upper jaw 1270 and lower jaw 1290 of first embodiment tool head 1220. Upper jaw clamping extension 1370 and lower jaw clamping extension 1390 are capable of capturing and holding a work piece (not shown) therebetween, such as tissue being operated upon during a surgical procedure.

A detachable third embodiment tool head assembly, generally referred to as 1400, comprises an upper jaw 1410 having a upper sharpened edge 1420 and a lower jaw 1430 having a lower sharpened edge 1440. Upper jaw 1410 and lower jaw 1430 of second embodiment tool head assembly 1440 are capable of pivoting about pivot pin 1260 in a manner substantially similar to the pivoting action of upper jaw 1270 and lower jaw 1290 of first embodiment tool head 1220. Upper sharpened edge 1420 and lower sharpened edge 1440 are capable of shearing a work piece (not shown) therebetween, such as a bolt or cable.

Figure 12:
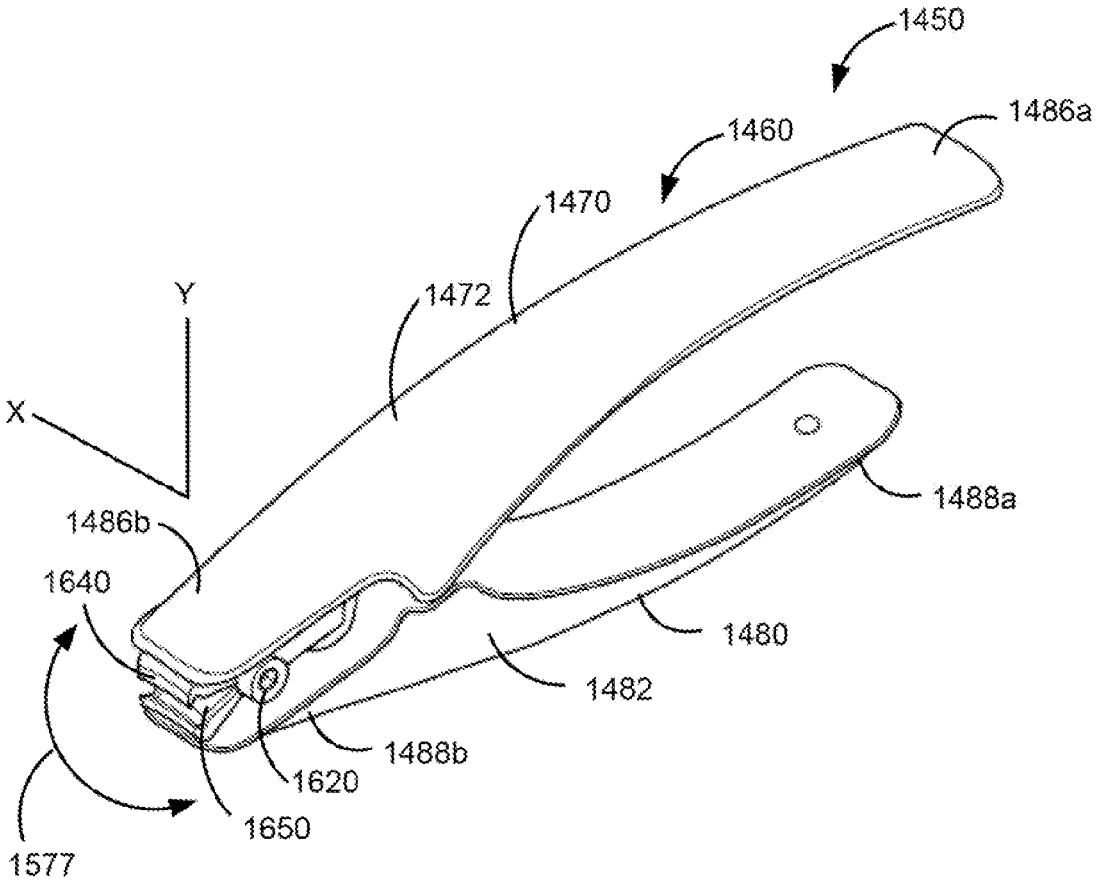
FIG. 12 is a view in perspective of a second embodiment hand tool including a tool head assembly configured as a fingernail or toe nail clipper, the second embodiment hand tool being shown in an open position.
Figure 13:
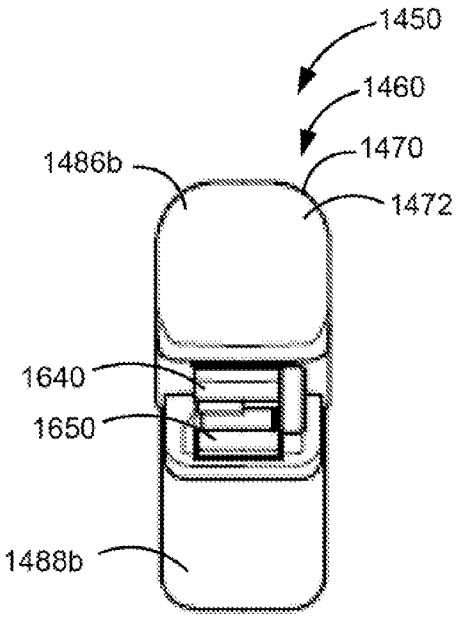
FIG. 13 is a front view in elevation of the second embodiment hand tool.
Figure 14:
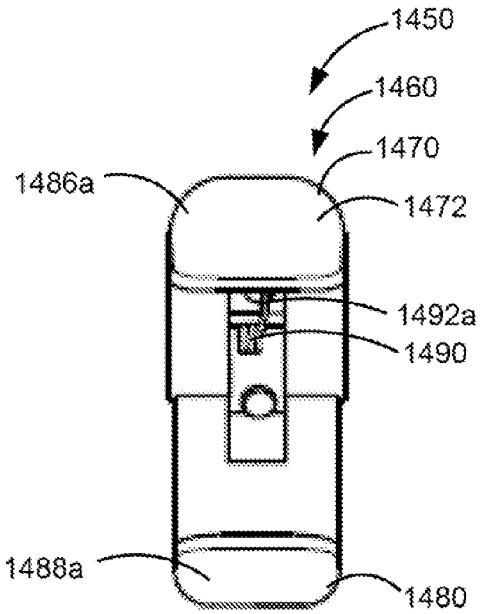
FIG. 14 is a rear view in elevation of the second embodiment hand tool.

Turning now to FIGS. 12, 13 and 14, there is shown a second embodiment hand tool, generally referred to as 1450. The second embodiment hand tool 1450 comprises a second embodiment hand held tool mount or handle assembly 1460 shown oriented in a y-axis or first plane. Handle assembly 1460, which is sized for hand manipulation or grasping by the user, comprises an upper handle member 1470 that includes a generally smooth, contoured, arcuate-shaped upper shell 1472 that matingly covers an arcuate-shaped upper frame member 1475. Upper frame member 1475 has a proximal end portion 1477*a* and a distal end portion 1477*b*. Handle assembly 1460 further comprises a lower handle member 1480 that includes a generally smooth, contoured, arcuate-shaped lower shell 1482 that matingly covers an arcuate-shaped lower frame member 1484. Lower frame member 1484 has a proximal end portion 1485*a* and a distal end portion 1485*b*. Lower handle member 1480 is disposed in the first plane opposite upper handle member 1470. The contoured or arcuate shape of upper shell 1472 that belongs to upper handle member 1470 and the contoured or arcuate shape of lower shell 1482 that belongs to lower handle member 1480 facilitates grasping thereof by the user of hand tool 1450. Frame members 1475/1484 provide support for shells 1472/1482 and serves other useful functions, as described hereinbelow. Upper handle member 1470 defines a proximal end portion 1486*a* and a distal end portion 1486*b* for reasons recited hereinbelow. Similarly, lower handle member 1480 defines a proximal end portion 1488*a* and a distal end portion 1488*b* for reasons recited hereinbelow. Hand tool 1450 is also provided with a resilient biasing member in the form of a coiled torsion spring 1490 for reasons provided hereinbelow. Torsion spring 1490 is disposed between upper handle member 1470 and lower handle member 1480. Torsion spring 1490 is configured to have a pair of protruding ends 1492*a*/1492*b* thereof in contact with upper handle member 1470 and lower handle member 1480, respectively, for providing a biasing force against upper handle member 1470 and lower handle member 1480. In this manner, torsion spring 1490 provides a biasing return force to maintain upper handle member 1470 and lower handle member 1480 in an open default position, as shown, Upper handle member 1470 and lower handle member 1480 are maintained in the open default position until the user simultaneously applies manual pressure to upper handle member 1470 and lower handle member 1480 to move upper handle member 1470 and lower handle member 1480 closer together. This act by the user places torsion spring 1490 in compression. Upon release of the manual pressure by the user, torsion spring 1490 is released from its compressed state and expands, so that handle members 1470/1480 return to their open, default positions.

Figure 19:
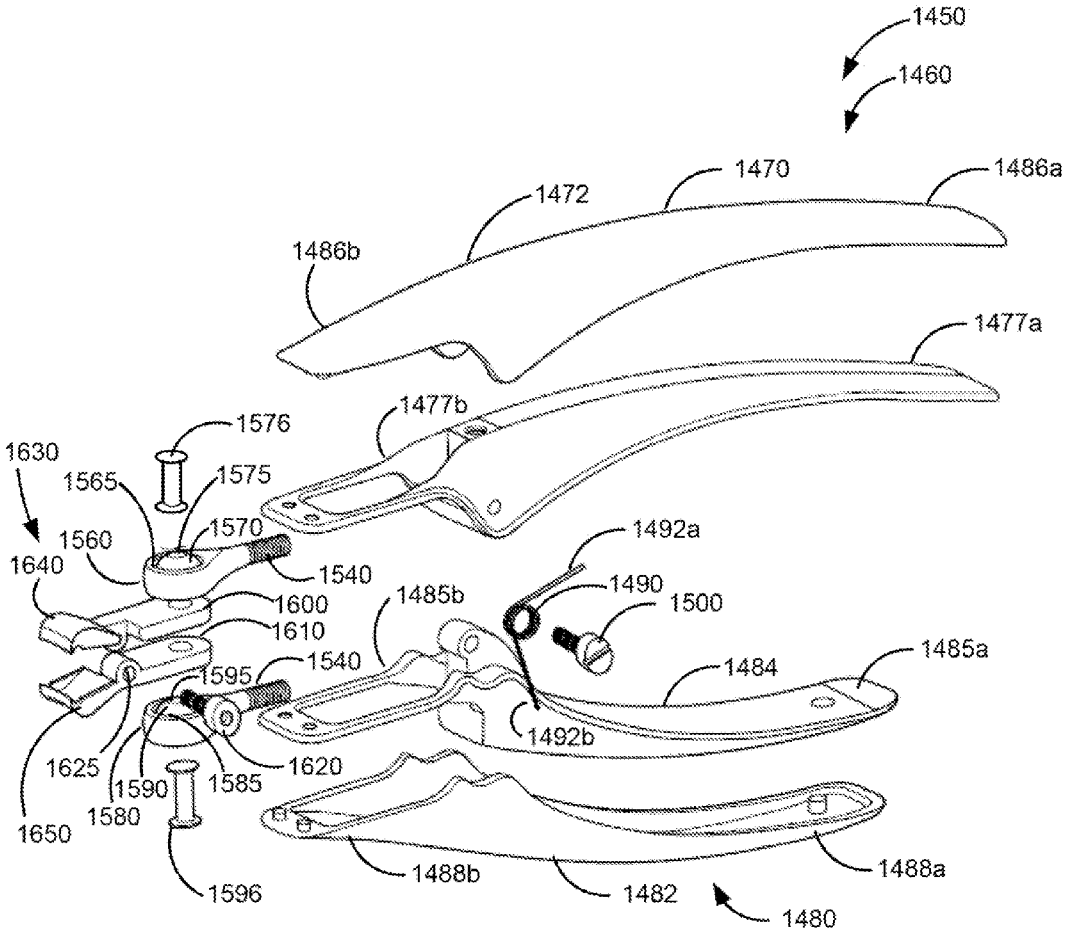
FIG. 19 is an exploded view of the second embodiment hand tool.

Referring again to FIGS. 12, 13 and 14, upper handle member 1470 and lower handle member 1480 are pivotably connected to each other on an axis defined by a mounting or linkage bolt 1500 (see FIG. 19) and are held apart from one another, in a default position, by the previously mentioned torsion spring 1490. Linkage bolt 1500 therefore facilitates holding the two handle members 1470/1480 pivotally together. Although torsion spring 1490 of a particular configuration is illustrated, it should be understood by those skilled in the art that other suitable biasing or spring means may be utilized, such as a coiled compression spring (not shown) or other suitable spring means.

Figure 15:
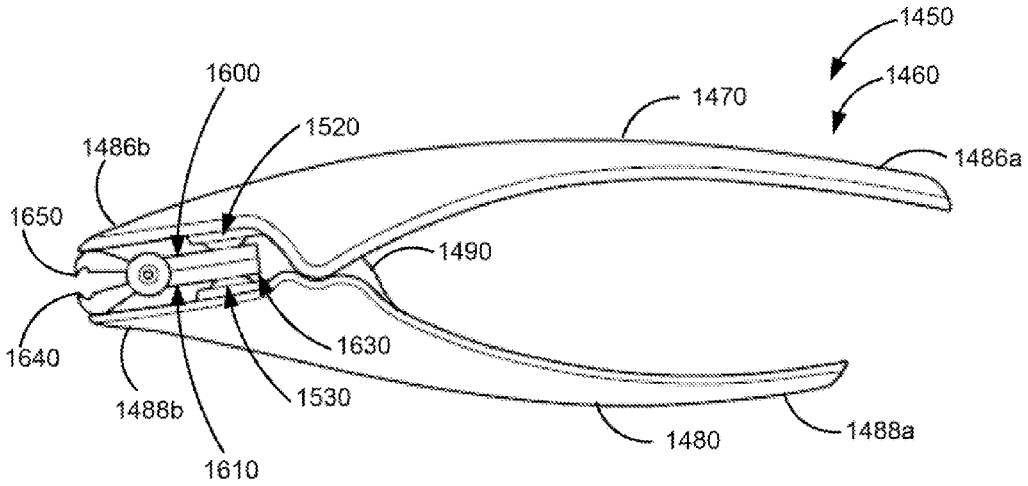
FIG. 15 is a right side view in elevation of the second embodiment hand tool.
Figure 16:
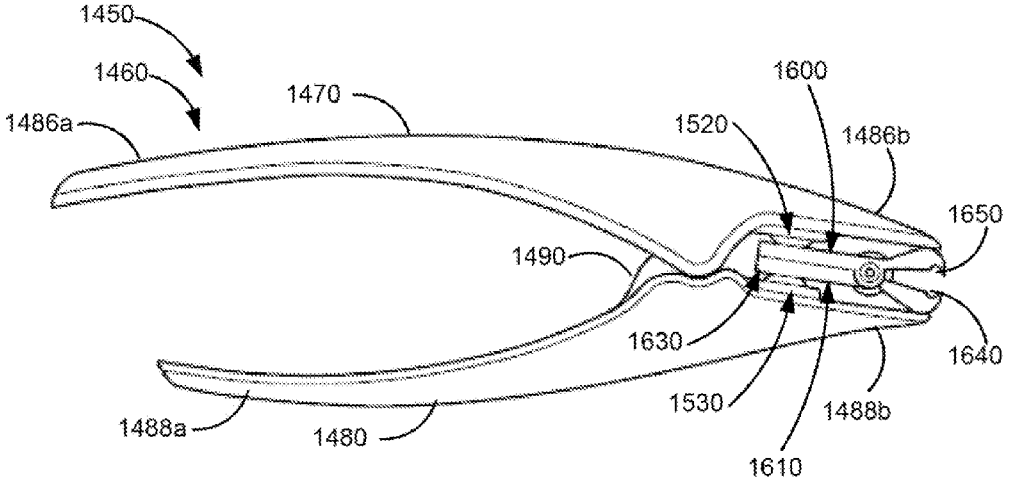
FIG. 16 is a left side view in elevation of the second embodiment hand tool.
Figure 16A:
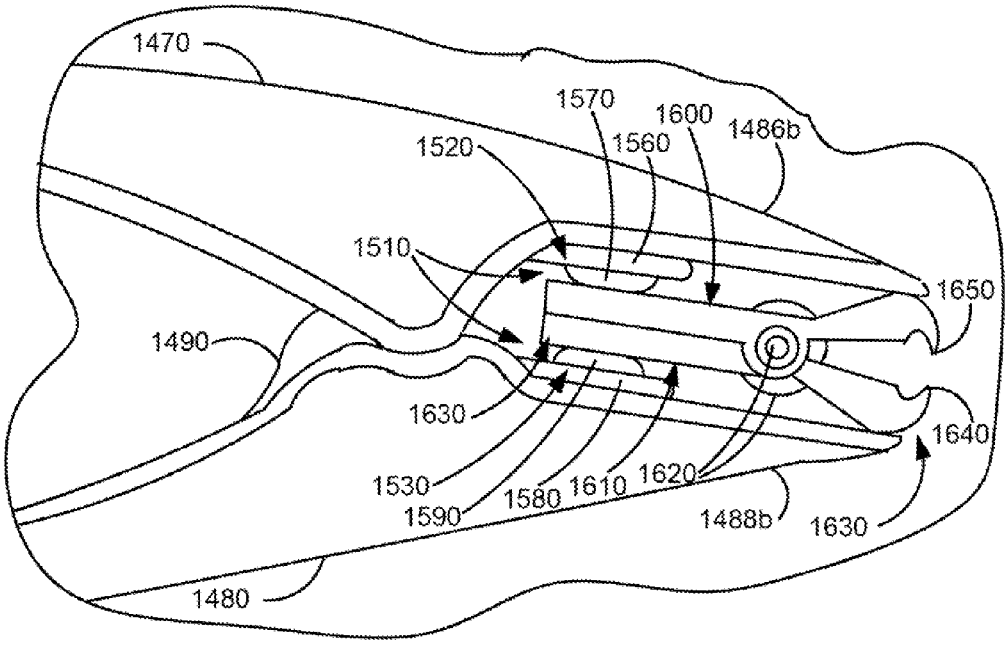
FIG. 16A is a fragmentary view in elevation of a distal end portion of the second embodiment hand tool.
Figure 17:
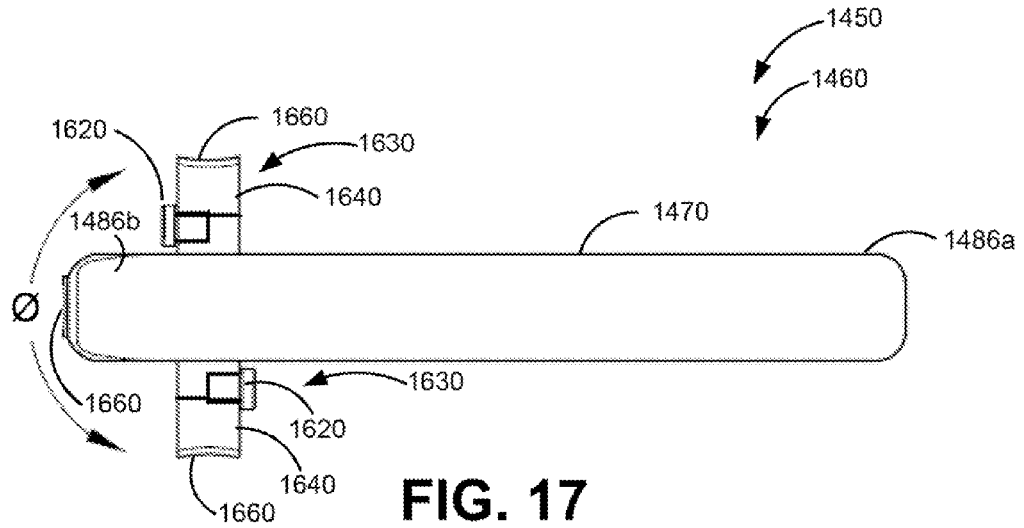
FIG. 17 is a top plan view of the second embodiment hand tool.
Figure 18:
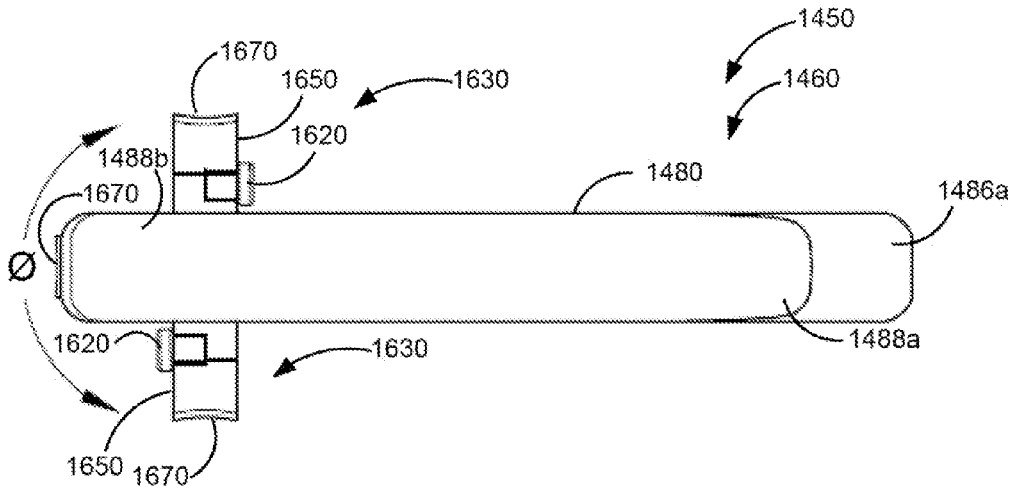
FIG. 18 is a bottom plan view of the second embodiment hand tool.
Figure 18A:
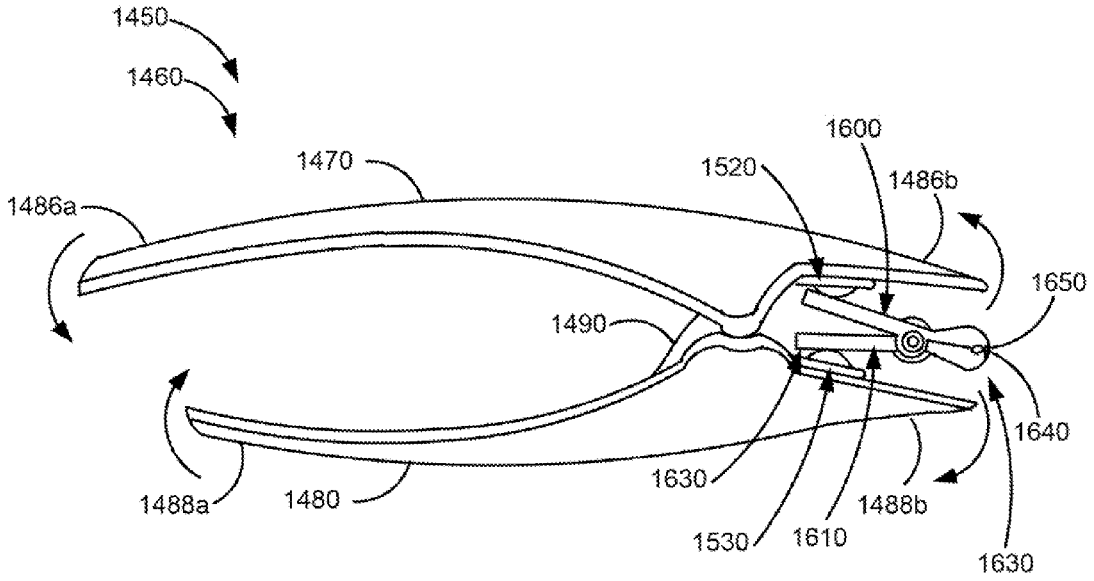
FIG. 18A is a view in elevation of the second embodiment hand tool in a closed position.

Referring to FIGS. 15 and 16, hand tool 1450 generally includes a tool mount or coupler assembly indicated generally at 1510. The coupler assembly 1510 includes an upper mount or upper coupler in the form of an articulating upper heim joint, generally referred to as 1520. Coupler assembly 1510 further includes a lower mount or lower coupler in the form of an articulating lower heim joint, generally referred to as 1530. Upper heim joint 1520 is threadably attached to distal end portion 1477*b* of upper frame member 1475 by means of an elongate, externally threaded upper shank portion 1540 (see FIG. 19) that is received in an internally threaded upper bore or hole (not shown) formed in distal end portion 1477*b*. Similarly, lower heim joint 1530 is threadably attached to distal end portion 1485*b* of lower frame member 1484 by means of an elongate, externally threaded lower shank portion 1550 that is received in an internally threaded lower bore or hole (not shown) formed in distal end portion 1485*b*. Thus, upper shank portion 1540 is threadably received in the upper hole and lower shank portion 1550 is threadably received in the lower hole for coupling shank portions 1540/1550 to handle members 1470/1480, respectively. However, shank portions 1540/1550 and their respective holes need not be threaded; rather, shank portions 1540/1550 and their respective holes may be smooth and sized for allowing coupling of shank portions 1540/1550 to handle members 1470/1480 by means of a press-fit.

Referring to FIGS. 15, 16, 17, 18 and 19, upper heim joint 1520 comprises an annular upper casing 1560 integrally attached to upper shank portion 1540. Upper casing 1560 defines an opening 1565 therethrough for reasons provided hereinbelow. In addition, upper casing 1560 may have a generally spherical interior (not shown) contoured for slidably, matingly receiving a spherical upper ball swivel 1570, such that upper ball swivel 1570 is slidably retained within upper casing 1560. Upper ball swivel 1570 defines a hole 1575 (see FIG. 19) centrally therethrough for receiving a smooth upper connector pin 1576 about which upper ball swivel 1570 freely rotates in the x-plane. Connector pin 1576 also interconnects upper ball swivel 1570 to upper frame member 1475 and to an upper tool member 1600 as will be explained hereinafter in greater detail. In this manner, upper ball swivel 1570 is capable of multi-directional, slidable movement within upper casing 1560. In other words, upper ball swivel 1570 is capable of side-to-side, rotational, or swivel movement in the horizontal x-axis plane as illustrated by directional arrow 1577 (see FIG. 12).

Referring again to FIGS. 15, 16, 17, 18 and 19, lower heim joint 1530 comprises an annular lower casing 1580 integrally attached to lower shank portion 1550. Lower casing 1580 defines an opening 1585 therethrough for reasons provided hereinbelow. In addition, lower casing 1580 may have a generally spherical interior (not shown) contoured for slidably, matingly receiving a spherical lower ball swivel 1590, such that lower ball swivel 1590 is slidably retained within lower casing 1580. Lower ball swivel 1590 defines a hole 1595 (see FIG. 19) centrally therethrough for receiving a smooth lower connector pin 1596 about which lower ball swivel 1590 freely rotates in the x-plane. Connector pin 1596 also interconnects lower ball swivel 1590 to lower frame member 1484 and to a lower tool member 1610 as will be explained hereinafter in greater detail. In this manner, lower ball swivel 1590 is capable of multi-directional, slidable movement within lower casing 1580. In other words, lower ball swivel 1590 is capable of side-to-side, rotational, or swivel movement in the horizontal x-axis plane as illustrated by previously mentioned directional arrow 1577 (see FIG. 12). As described fully hereinbelow, it will be appreciated that ball swivels 1570/1590 will rotate in unison and to a like extent due to their interconnection by means of the upper tool member 1600, the lower tool member 1610 and a pivot pin 1620 (see FIGS. 12, 15, 16 and 19). Lower tool member 1610 includes a hole 1625 for reasons provided hereinbelow.

Still referring to FIGS. 15, 16, 17, 18 and 19, to provide hand tool 1450 with the functionality noted hereinabove, hand tool 1450 further includes a tool head assembly, generally referred to as 1630, for clipping fingernails and toe nails of the user of hand tool 1450. In other words, tool head assembly 1630, which is coupled to handle assembly 1460 by means of coupler assembly 1510, is capable of operating on (i.e., clipping) the fingernails and toe nails (i.e., the work piece) of the user in response to hand manipulation of handle assembly 1460, as described in detail presently. In this regard, tool head assembly 1630 generally includes the upper tool member or upper jaw 1600 and the lower tool member or lower jaw 1610. Upper tool member 1600 and lower tool member 1610 are both disposed in the y-axis plane, lower tool member 1610 being oriented opposite to and coincident with upper tool member 1600. Lower tool member 1610 and upper tool member 1600 are pivotably interconnected by previously mentioned pivot pin 1620 that is sized to be received in previously mentioned hole 1625, such as by a press fit. Thus, the pivotable interconnection of lower tool member 1610 and upper tool member 1600 allow lower tool member 1610 and upper tool member 1600 to pivot about pivot pin 1620.

Referring again to FIGS. 15, 16, 17, 18 and 19, upper tool member 1600 has an inwardly-curved first cutting edge portion 1640. Similarly, lower tool member 1610 has an inwardly curved second cutting edge portion 1650. Fingernails and toe nails of the user are clipped or cut when cutting edge portions 1640/1650 are brought to bear against each other in the manner described hereinabove.

Illustrative Methods:

An illustrative method associated with an exemplary embodiment for manufacturing the hand tool will now be described.

Figure 20:
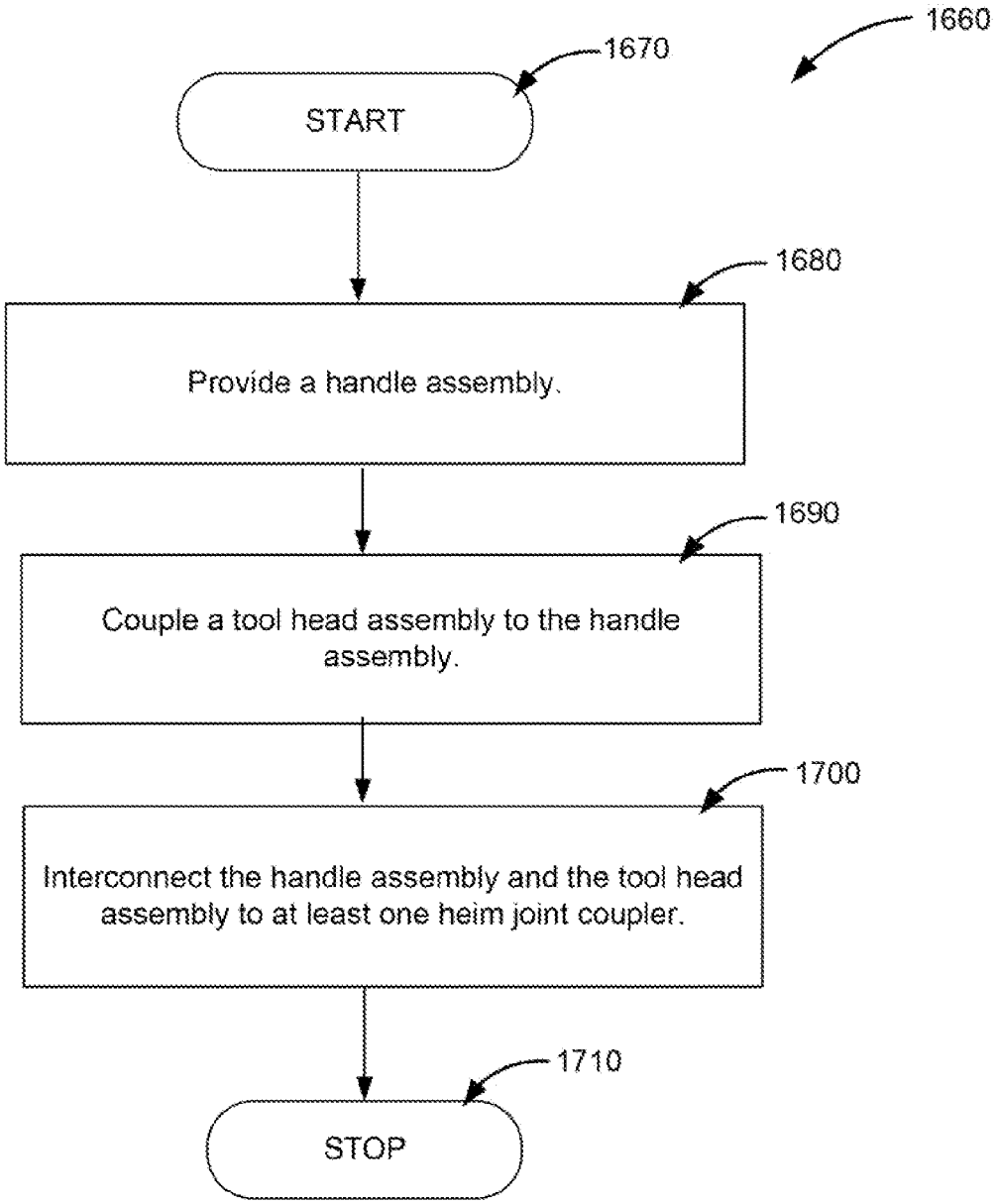
FIG. 20 is a flowchart showing an illustrative method of manufacturing the first and second embodiments of the hand tool.

Referring to FIG. 20, an illustrative method, generally referred to as 1660, is provided for manufacturing a hand tool. The method starts at a step 1670. At a step 1680, a handle assembly is provided. At a step 1690, a tool head assembly is coupled to the handle assembly. At a step 1700, the handle assembly and the tool head assembly are interconnected to at least one heim joint coupler. The method stops at a step 1710.

Other modifications and implementations will occur to those skilled in the art without departing from the spirit and the scope of the invention as claimed. For example, handle assembly 1010 belonging to the first embodiment hand tool 1000 may be coupled to a hydraulic system that is, in turn, hand actuated. Such a hydraulic system would be coupled to upper handle member 1020 and lower handle 1030 for hydraulically operating upper and lower handle members 1020/1030. As another example, handle assembly 1010 may be coupled to an electric motor system that is, in turn, hand operated by means of a suitable guidance control switch. Such an electric motor system would be coupled to upper handle member 1020 and lower handle member 1030 for electrically operating upper and lower handle members 1020/1030 and for articulating the tool head assembly by means of electric motors. These examples can be used for cutting bolts and cables. Accordingly, the description hereinabove is not intended to limit the invention, except as indicated in the following claims.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. The issued patent may not be interpreted to be limited to the specific examples or embodiments or methods specifically and/or expressly disclosed herein. Under no circumstances may the issued patent be interpreted to be limited by any statement made by any Examiner or any other official or employee of the Patent and Trademark Office unless such statement is specifically and without qualification or reservation expressly adopted in a responsive writing by Applicant(s).

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Therefore, provided herein area hand tool and a method of manufacturing and using same.

PARTS LIST

1000 a hand tool
1010 a first embodiment hand held tool mount or handle assembly
1020 an upper handle member
1032*a* a proximal end portion
1032*b* a distal end portion
1030 a lower handle member
1035*a* a proximal end portion
1035*b* a distal end portion
1040 an elongate leaf spring

1050 a central straight segment portion
1050*a* an upper straight portion
1050*b* a lower rounded or curved end portion
1060 a lower handle cutout [SUGGEST IDENTIFY AS 1036 under 1030
1070 a mounting or spring pin
1075*a* a direction arrow for upper handle squeezing toward lower handle member
1075*b* a direction arrow for lower handle squeezing toward upper handle member
1080 a mounting or linkage bolt
1090 a heim joint coupler assembly
1100 an articulating upper heim joint
1110 an articulating lower heim joint
1120 an upper shank portion
1130 an upper bore or hole
1140 a lower shank portion
1150 a lower bore or hole
1160 an annular upper casing
1165 an upper casing opening
1170 an upper spherical ball swivel
1180 a upper ball hole
1182 a swivel direction arrow for upper ball swivel
1184 a y-axis tilting direction arrow for upper ball swivel
1186 an x-axis tilting direction arrow for upper/lower ball swivel
1190 an annular lower casing
1195 a lower casing opening
1200 a lower spherical ball swivel
1205 a y-axis tilting direction for lower ball swivel
1210 a lower ball hole
1220 a replaceable first embodiment tool head assembly
1230 an upper tool member
1240 a lower tool member
1250*a* a lower tool member or first pivoting portion
1250*b* an upper tool member or second pivoting portion
1260 an interconnecting pivot pin
1270 an upper jaw or upper blade tool
1280 a first or upper tool elongate front cutting edge portion
1290 a lower jaw or lower blade tool
1300 a second or lower tool elongate front cutting edge portion
1304*a* a first or upper tool member upper arm portion
1306*a* a first or upper tool member upper arm bore
1304*b* a second or upper tool member lower arm portion
1306*b* a second or upper tool member lower arm bore
1308*a* a third or lower tool member upper arm portion
1308*b* a fourth or lower tool member lower arm portion
1309*a* a lower tool upper arm bore
1309*b* a lower tool lower arm bore
1330 an upper tool screw bolt
1340 a lower tool screw bolt
1350 a detachable second embodiment tool head assembly
1360 an upper jaw
1370 an upper jaw clamping extension 1370
1380 a lower jaw 1380
1390 a lower jaw clamping extension
1400 a detachable third embodiment tool head assembly
1410 an upper jaw 1410
1420 a upper sharpened edge 1420
1430 a lower jaw 1430
1440 a lower sharpened edge 1440
1450 a second embodiment hand tool
1460 a second embodiment hand held tool mount or handle assembly
1470 an upper handle member 1470
1472 a generally smooth, contoured, arcuate-shaped upper shell 1472
1475 an arcuate-shaped upper frame member 1475
1477*a* a proximal end portion 1477*a*
1477*b* a distal end portion 1477*b*
1480 a lower handle member 1480
1482 a contoured, arcuate-shaped lower shell 482
1484 an arcuate-shaped lower frame member 1484
1485*a* a proximal end portion 1485*a*
1485*b* a distal end portion 1485*b*.
1486*a* a proximal end portion 1486*a*
1486*b* a distal end portion 1486*b*
1488*a* a proximal end portion 1488*a*
1488*b* a distal end portion 1488*b*
1490 a coiled torsion spring 1490
1500 a mounting or linkage bolt 1500
1510 a tool mount or coupler assembly 1510
1520 an articulating upper heim joint 1520
1530 an articulating lower heim joint 1530
1540 an elongate, externally threaded upper shank portion 1540
1550 an elongate, externally threaded lower shank portion 1550
1560 an annular upper casing 1560
1565 an opening 1565
1570 a spherical upper ball swivel 1570
1575 a hole 1575
1576 a smooth upper connector pin 1576
1577 a directional arrow 1577
1580 an annular lower casing 1580
1585 an opening 1585
1590 a spherical lower ball swivel 1590
1595 a hole 1595
1596 a smooth lower connector pin 159
1610 a lower tool member 1610
1620 a pivot pin 1620
1625 a hole 1625
1630 a tool head assembly 1630
1640 an inwardly-curved first cutting edge portion 1640
1650 an inwardly curved second cutting edge portion 1650

I claim:

1. A hand tool, comprising:

(a) a handle assembly oriented in a first plane and sized for hand manipulation;

(b) a tool head assembly coupled to said handle assembly for operating on a work piece in response to hand manipulation of said handle assembly;

(c) at least one heim joint coupler interconnecting said handle assembly and said tool head assembly for rotating said tool head assembly to a selected angle relative to said handle assembly; and (d) a biasing member coupled to said handle assembly for biasing said handle assembly to an open position.

2. The hand tool of claim 1, wherein said at least one heim joint coupler comprises a ball swivel adapted to be coupled to said tool head assembly for facilitating rotation of said tool head assembly.

3. A hand tool, comprising:

(a) a handle assembly including a pair of handles oriented in a first plane and sized for hand manipulation;

(b) a tool head assembly coupled to said handle assembly for operating on a work piece in response to hand manipulation of said pair of handles; and (c) at least one heim joint coupler interconnecting said handle assembly and said tool head assembly for rotating said tool head assembly to a selected angle relative to said handle assembly, so that the tool head assembly is oriented to operate on the work piece at the selected angle.

4. The hand tool of claim 3, wherein said at least one heim joint coupler comprises a ball swivel coupled to said tool head assembly for facilitating rotation of said tool head assembly.

5. The hand tool of claim 3, further comprising a biasing member coupled to said pair of handles for biasing said pair of handles from a closed position to an open position.

6. The hand tool of claim 5, wherein said biasing member is a compression spring.

7. The hand tool of claim 3, wherein said tool head assembly comprises a pair of oppositely disposed jaws coupled to respective ones of said pair of handles for engaging the work piece during hand manipulation of said pair of handles.

8. The hand tool of claim 7, wherein each of said jaws defines a cutting edge portion thereon.

9. The hand tool of claim 7, wherein each of said jaws defines a clamping edge portion thereon.

10. The hand tool of claim 7, further comprising a pivot pin pivotally interconnecting said pair of jaws for pivoting said pair of jaws about said pivot pin.

11. The hand tool of claim 3, wherein said tool head assembly is adapted to be decoupled from said handle assembly.

12. The hand tool of claim 3, wherein aid tool head assembly is adapted to rotate 180 degrees in the second plane.

13. The hand tool of claim 3, further comprising a linkage bolt pivotably linking said pair of handles for pivoting said pair of handles about said linkage bolt.

14. A method of manufacturing a hand tool, comprising the steps of:

(a) providing a handle assembly;

(b) coupling a tool head assembly to the handle assembly;

(c) interconnecting the handle assembly and the tool head assembly to at least one helm joint coupler; and (d) coupling a biasing member to the handle assembly.

15. The method of claim 14, wherein the step of interconnecting the handle assembly, the tool head assembly and the at least one helm joint coupler comprises the step of interconnecting at least one helm joint coupler including a ball swivel.

16. The method of claim 14, wherein the step of coupling a biasing member to the handle assembly comprises the step of coupling a compression spring to the handle assembly.

17. The method of claim 14, wherein the step of coupling a tool head assembly to the handle assembly comprises the step of coupling a pair of oppositely disposed jaws to the handle assembly.

18. The method of claim 14, wherein the step of coupling a tool head assembly to the handle assembly comprises the step of coupling a tool head assembly adapted to be decoupled from the handle assembly.

* * * * *